US005472547A

United States Patent [19]

McKye et al.

[11] Patent Number: 5,472,547

[45] Date of Patent: Dec. 5, 1995

[54] BADGE HOLDER AND METHOD OF MAKING SAME

[75] Inventors: Marshall W. S. McKye, High Ridge, Mo.; Arne Mohler, Olstykke; Henrik Nyborg, Varlose, both of Denmark

[73] Assignee: Technical Sales & Services, Inc., Fenton, Mo.

[21] Appl. No.: 43,539

[22] Filed: Apr. 6, 1993

[51] Int. Cl.[6] ..... B32B 31/08; B32B 31/10; B32B 31/18; B32B 31/28

[52] U.S. Cl. ..... 156/269; 156/66; 156/250; 156/290; 156/275.5; 156/275.7; 40/1.5; 269/8

[58] Field of Search ..... 40/1.5; 156/250, 156/251, 269; 269/8

[56] References Cited

U.S. PATENT DOCUMENTS

| | | | |
|---|---|---|---|
| 2,171,259 | 8/1939 | Scott | 156/269 |
| 3,295,235 | 1/1967 | Tauber | 40/1.5 |
| 3,793,112 | 2/1974 | Sontag et al. | 156/324.4 |
| 4,043,858 | 8/1977 | Dantowitz | 156/251 |
| 4,126,504 | 11/1978 | Wolinski et al. | 156/310 |
| 4,869,004 | 9/1989 | Maloney | 40/1.5 |

FOREIGN PATENT DOCUMENTS

| | | | |
|---|---|---|---|
| 2244255 | 11/1991 | United Kingdom | 40/1.5 |

*Primary Examiner*—David A. Simmons
*Assistant Examiner*—M. Curtis Mayes
*Attorney, Agent, or Firm*—Paul M. Denk

[57] ABSTRACT

A plastic badge holder and method of making same is provided having two opposing sides, laminated together at three edges, thereby forming a pocket between the sides in which to insert a badge or card, or having other folds to provide for enclosure of an identification card therein. The badge holder has a pin affixed with adhesive to the back side for pinning the badge on the wearer. The badge is formed by forming a pair of overlying laminates, securing the laminates together by welding, while simultaneously cutting the configured badge, collecting the badges, stacking them in a chute, delivering the laminates by means of a rotatable index machine to a conveyor, such as a magnetic conveyor, indexing the emplaced laminates by means of the conveyor to a position where a pin is delivered by robot arm to the badge, further indexing the laminates, applying precisely a spot of glue onto the pin laminate juncture, further indexing the laminates to a curing structure, where the adhesive is cured or hardened to rigidly affix the pin to the laminates, to form an identification badge holder, after which time the conveyor delivers the completed badges to a collection station.

2 Claims, 3 Drawing Sheets

BADGE HOLDER AND METHOD OF MAKING SAME

BACKGROUND OF THE INVENTION

This invention relates to a badge holder and a method for making the badge holder, more specifically to a laminated plastic badge holder having a pin on the back for pinning the badge to the wearer and to a method for making same.

Reusable or disposable pin-back badges are well-known to the art. Badges are a convenient way of displaying the wearer's name, a company name or the like. The badges are particularly popular with attendees at conferences, conventions or educational programs. It is desirable to make a badge from a thin, flexible plastic material preferably clear so as not to distort the optics, into which a printed paper or cardboard message or name card can be inserted. The plastic badge should have an attachment means on the back for attaching the badge to the wearer, for example, a pin, not unlike a safety pin, that can be attached to the wearer's clothing.

There are many types of badges known to the prior art. For example, U.S. Pat. No. 2,341,083 to DeSwart shows a badge mounting. In this particular instance the pin is fixed into a boss while the other end extends and is held into a projecting socket member. The patent to Stoffel, U.S. Pat. No. 3,256,626 shows a medallion having a pin on the back that is held by a block or boss at one end and apparently locks into position at an opposite boss. U.S. Pat. No. 3,257,747 to Schimmel illustrates a badge and a method of making the same wherein the badge is held by means of a stick pin in the usual fashion. The pin is pivotably mounted to its support capable of being fixed at its rotary latch.

U.S. Pat. No. 3,466,773 to Kessler, illustrates another form of pin attachment for a plastic badge and the method of making the same. It appears that the back of the badge includes a pair of upstanding ridges into which the pin is compressed and then some form of heat means is used to slightly melt the plastic ridges to hold the pin in place. U.S. Pat. No. 3,953,910 to Farb discloses an anchoring method comprising a badge having a pin secured to the badge by means of anchoring the pin to the backside of the base of the badge. U.S. Pat. No. 4,000,570 to Carmen, discloses an identification card holder. In this particular invention, a safety pin is secured by various methods such as striking it through openings.

Finally, U.S. Pat. No. 4,869,004 to Malloney illustrates a badge holder with a pin back formed from folded polymer sheet to which the pin is attached by a bead of curable adhesive.

SUMMARY OF THE INVENTION

It is therefore, an object of the present invention to provide a badge holder formed from two sheets of laminated material.

Still another object of the invention is to provide a badge holder having an opening between the sheets of material in which a badge can be inserted.

It is another object of the invention to provide a badge holder having a pin means attached to the back side.

It is a further object of the invention to provide a method for making laminated badge holders in which the sheets of plastic are laminated together and then cut to the desired size.

It is still another object of the invention to provide a method for making a laminated plastic badge holder in which the pin which is to be applied to the back side of the badge is positioned over the badge by use of a positioning magnet.

Still another object of the invention is to provide a method for making a laminated badge holder with a pin on the back wherein the pin is glued to the backside of the badge using a curable resin adhesive.

Still another object of the invention is to provide a method for making laminated plastic badge holders in which the process of positioning and securing the pin to the back of the badge can be done to a plurality of badges at the same time.

Briefly stated, a badge holder is disclosed having two opposing sides made of plastic or other material, the sides being laminated about three edges creating a pocket between the sides for holding a card or badge and having an opening thereto. Although more layers than two can be used to add reinforcement to the badge holder. The badge has a pin on the back side affixed by a curable adhesive. A method for making a laminated plastic badge holder device having a pin on the backside so as to secure the badge to the wearer is disclosed consisting of aligning two opposing rolls of plastic, laminating the opposing sheets of plastic together, cutting the plastic to size, advancing the cut plastics so as to position the cut plastic under a vibratory feeder, feeding a pin to a badge, positioning the pin on the badge using a magnetic positioning device, applying a curable resin to the pin and the backside of the badge, curing the resin so as to form a hard adhesive bond. The present invention allows for the alignment and securing of pins to a plurality of badges at the same time.

DESCRIPTION OF THE PREFERRED EMBODIMENT

Figure 1:
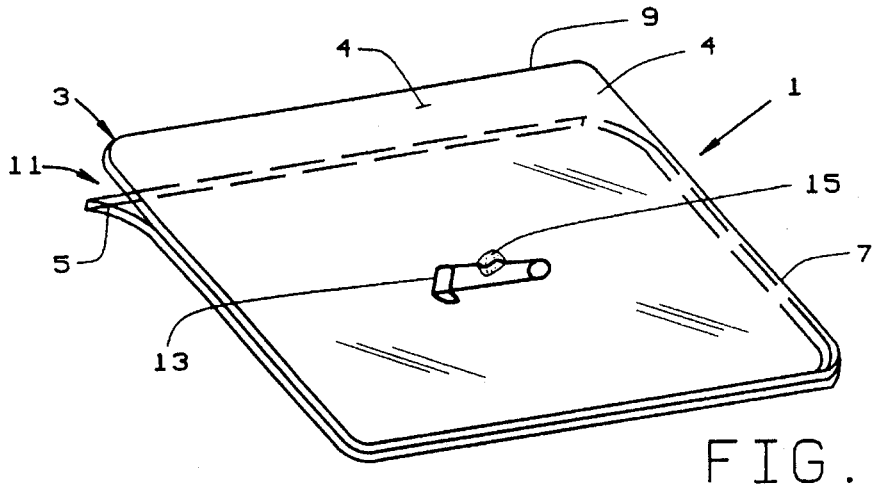
FIG. 1 is a perspective view of the badge holder of the present invention.

A badge holder constructed by the method of the present invention is shown generally at 1 in FIG. 1.

Badge holder 1 is preferably constructed of one opposing sheet of material 3 having lip 4, a second opposing sheet of material 5; the material may be any appropriate material such as plastic or a polyvinyl chloride that can be laminated as will be explained hereinafter.

Badge holder 1 is heat sealed or laminated about the edges as at 7 on three sides thereby forming a pocket between sheets 3 and 5 for holding a badge. The fourth edge 9 is left unsealed thereby creating opening 11 so that a paper or cardboard badge may be inserted.

It should be noted that the general configuration of badge 1 is rectangular but may be of any dimensions as desired without departing from the scope of the invention.

Badge holder 1 has a pin means 13 affixed to side 3 by a spot of adhesive or glue 15. Pin means 13 is affixed to side 3 at a proper point above the center of balance so that the badge hangs properly on the wearer.

Figure 2:
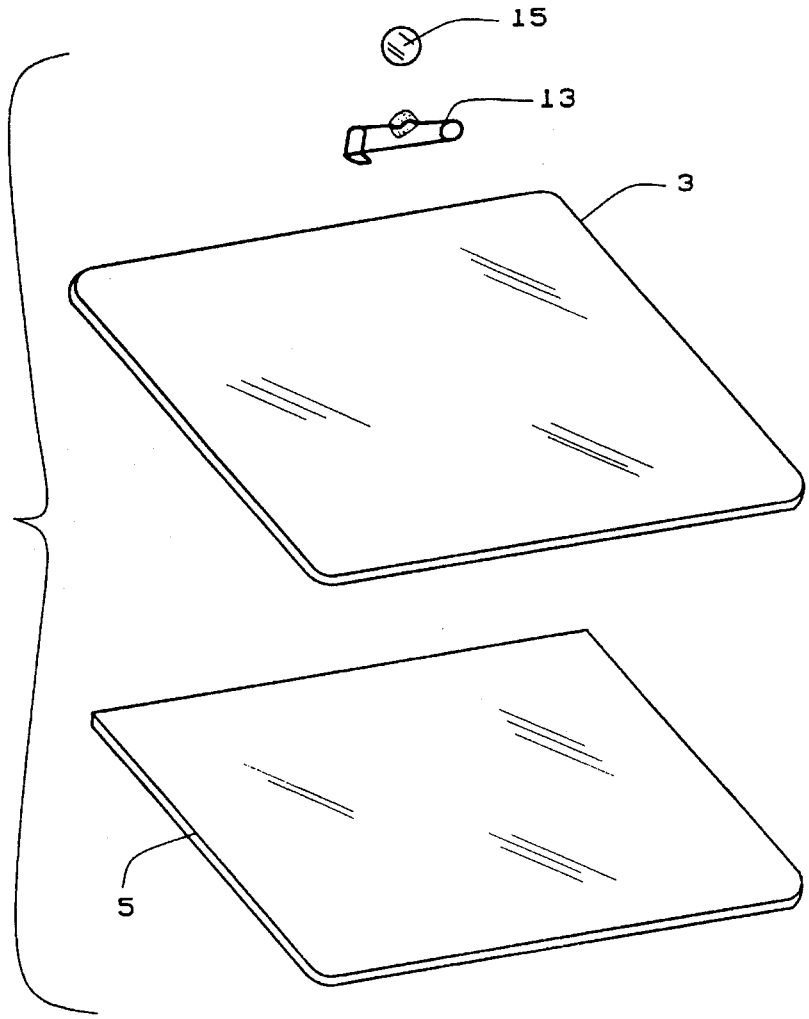
FIG. 2 is an exploded view of the badge of the present invention.

FIG. 2 illustrates the component parts of badge holder 1 and the relationship of those components. Side 3 is slightly undersized as to side 5 so that opening 11 is easily accessible to the user. A paper or cardboard badge can be placed against lip 4 of side 3 and then slipped down into the pocket through opening 11.

Figure 3:
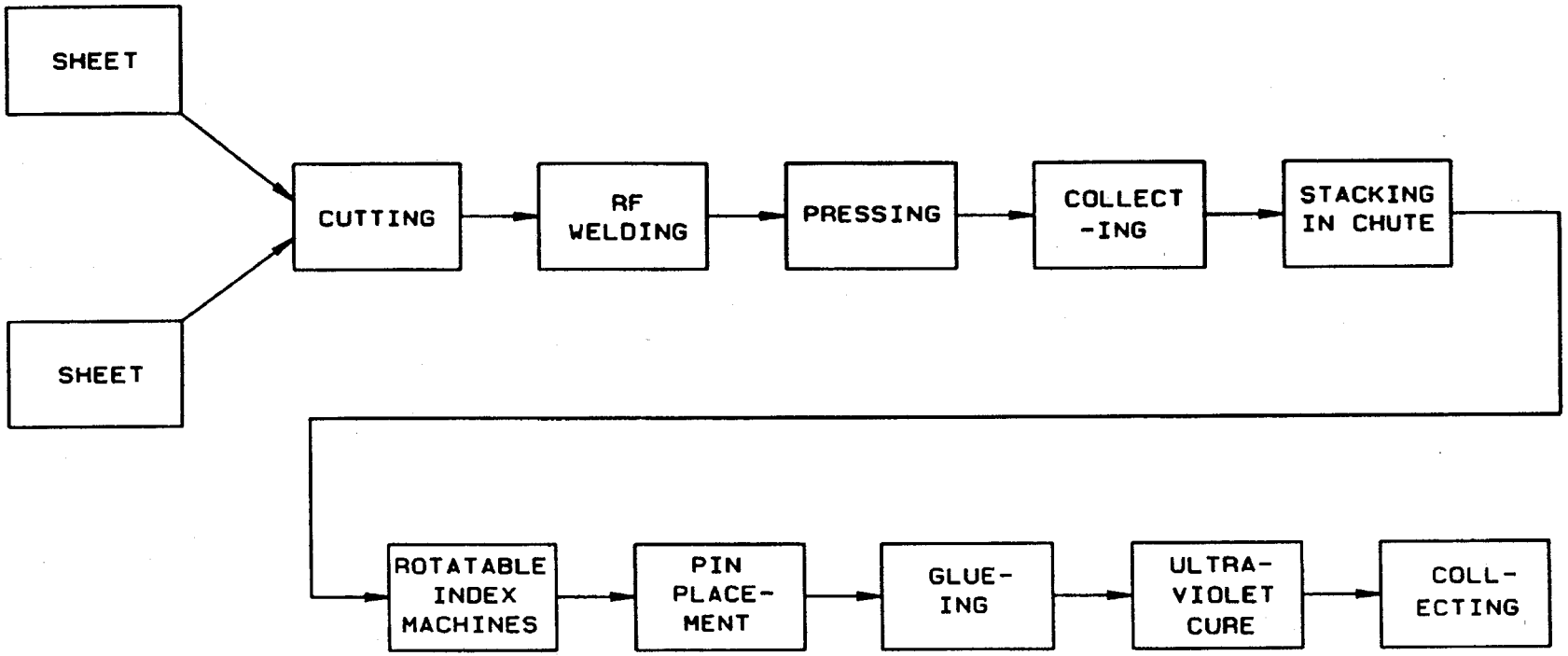
FIG. 3 is a block diagram detailing the method of making the badge of the present invention.

FIG. 3 is a block diagram illustrating the sequence of steps generally undertaken for forming the display badge of this invention. As can be noted, two opposing sheets of material, such as polyvinyl chloride, or the like, are fed from the rolls of sheets as noted. The opposing sheets are then laminated together, and delivered to a cutting station, for cutting into the badge configuration. Then, the overlying sheets pass through an RF welding apparatus, that welds the edges of the sheets together. If desired, the RF Welder could also be used to provide for the securement of the laminated sheets together, initially, with the welding providing for a weakened area around the periphery of the intended badge, to provide for automatic cutting and removal at that location, Following this, the laminated sheets may pass through a press, and then collected, and stacked into a chute means. In the chute means, the laminates may then be delivered either individually or in a plurality to a rotatable indexing machine, that may include a pair of feeding arms that may pick up one or a pair of the laminates, simultaneously, and deliver them to a conveyor means. Upon the conveyor means, the laminates may move into an alignment position for delivery to the location where pins may be delivered to the laminates, and located at the precise placement upon the intended back side of the badge, with said pins being delivered by means of a vibratory feeder, or the like, picked up by placement arms, and located precisely upon the badge during its assembly. As robot arms pick up the pins and deliver them to each of the emplaced laminates, the pins are properly positioned upon the back side of the badge, and then held thereto, as for example, by means of a magnetic conveyor, upon which the badge and pins now travel. Following this, the conveyor moves the combined badge and pins to a gluing position, where a spot of glue is applied to the juncture of each pin where it rests upon its laminate. The assembled badges then enter a curing station where the adhesive is cured by ultra-violet light, or by other resin curing means, or the like, or the adhesive may be of the type that when subjected to heat, as in the heat of a curing oven, it may harden immediately to firmly adhere the pins to their respective laminates. Following this, and finally, the assembled badge holders are then moved to a collection station for gathering.

Figure 4:
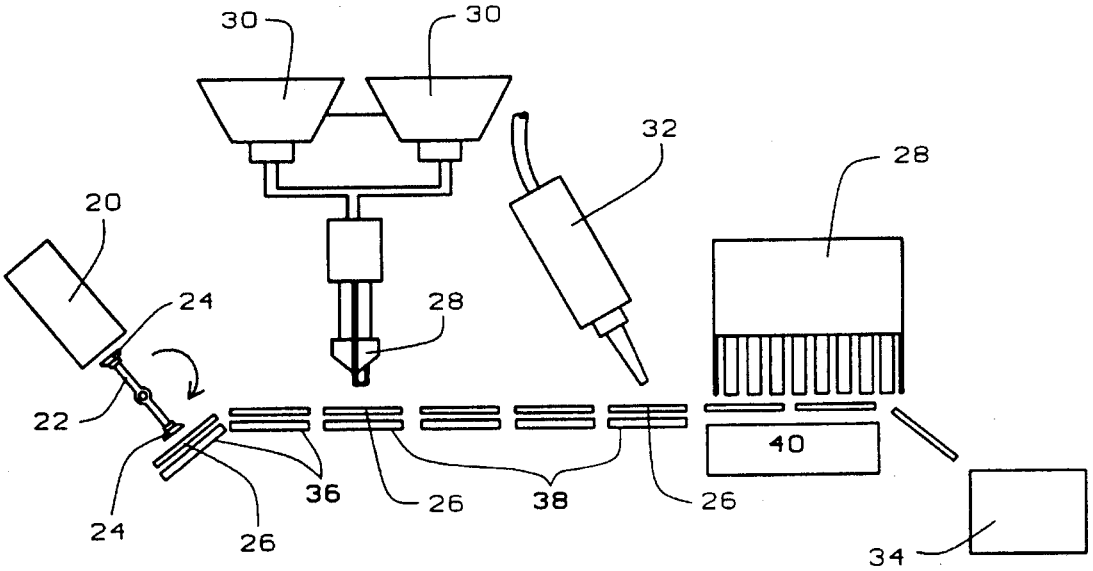
FIG. 4 is a schematic detailing one embodiment of the method of the present invention.

In referring to FIG. 4, there is shown still another schematic illustration of a further embodiment of the above process utilizing the assembly mechanism, as disclosed. Previously laminated material, such as the pair of properly sized and cut laminates that are heat welded together, and cut, such as at the cutting station 23, are then delivered to the assembly mechanism as shown in said FIG. 4. As disclosed, the assembly mechanism includes a conveyor means 26, generally comprised of a series of magnetic platens, generally include a delivery means that supplies two of the polymer laminates, side by side, upon the left platen 26 of the magnetic conveyor. Air suction means, at 36, may be used to hold the laminates in place. These laminates are fed by means of a supply trough 20, two at a time, onto a pair of indexed rotating arms 22 of the feeder mechanism. Vacuum pressure through the feeder mechanism arms 22 holds the laminates in place, the arms are indexed a half turn, and then deliver the cut laminates, as previously explained, in the preferred embodiment, side by side or in juxtaposition upon the left platen 26 of the conveyor. Then, the conveyor is further moved, by index means, into a position under the pin delivery mechanism 28, which is a clamping means that delivers pins from the vibratory feeders 30, once again, in pairs, directly to and overlying the adjacent laminates, resting upon the middle platen 26, as noted. Following this, the conveyor is then indexed a further distance, at which time the magnetically held pins upon the adjacent laminates each has a delivery of spots glued delivered by means of the glue delivery means 32, onto the pins, at which time the conveyor is then indexed further, to deliver the glue pinned laminates into a curing oven, as at 28, where the resin glue is cured, the pins are rigidly held in place upon the back laminate of the intended badge holder, at which time upon further indexing of the magnetic conveyor 26, the completed badges are then delivered into a collection bin 34, as can be seen. The magnetic holding means, at the position of 38, are used for holding the placed pins precisely upon the laminates. And, electronic controller 40 may be employed for controlling the indexing and other electrical operations of the conveyor. This is an example of further usage and application of the invention herein, to provide for automatic badge assembly, in the manner as described.

Figure 5:
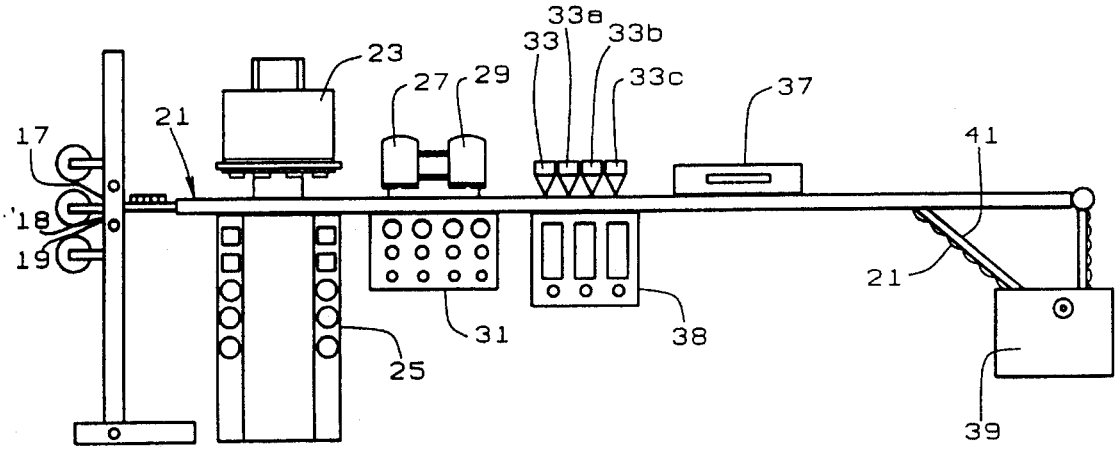
FIG. 5 is a schematic detailing another embodiment of the method of the present invention.

FIG. 5 illustrates a further embodiment of the above stated method of assembling the badge holder of the present invention. Two opposing rolls of material 17 and 19 enter the assembly machinery and are aligned and moved along conveyor 21 to heat sealing press and cutting station 23. The heat sealing press and cutting station 23 is controlled by sealing timer 25 so as to assure proper heat and pressure to seal the material. The laminated material is then cut into the desired size and moved along conveyor 21 to properly align under vibratory pin feeders 27 and 29, where a pair of pins are fed and emplaced upon a pair of laminated badge holders. Vibratory control panel 31 controls the alignment of the pins through a magnetic aligner (not shown) incorporated in pin feeders 27 and 29. The magnet properly aligns the pin on the badge so that the badge can be conveyed to glue applicators 33, **33*a*, 33*b*, and 33*c* where the glue is applied to the pin and the badge under the control of glue applicator control panel 38. It should be noted that a plurality of glue applicators can glue a plurality of pins to a plurality of badge assemblies at this step. For example, four glue applicators are illustrated in this embodiment. However, any number of glue applicators, such as two, can be conveniently used without departing from the scope of the invention. The badge assembly is then conveyed to ultra-violet or heat drying tunnel 37 where the glue is cured. Finally, the assembled and cured badge assemblies are conveyed to collection station 39. Conveyor belt 21 is recycled to the assembly process along conveyor return section 41**.

It is apparent that there has been provided, in accordance with the invention, a new and improved identification badge holder and method of making the same. While the inventions have been described in conjunction with specific embodiments, it will be evident to those skilled in the art that many alternatives and variations will be available in light of the foregoing description and illustrations. For example, it is likely that the glue applicator may be located before the pin delivery mechanism within the sequence of operation of this method. Therefore, it is intended to include all such alternatives and variations within the spirit and scope of the invention in the appended claims.

Having thus described the invention, what is claimed and desired to be secured by Letters Patent is:

1. A method for making a pin back badge holder for a pin and badge assembly comprising the steps of:

providing two opposing rolls of vinyl badge material;

laminating the opposing rolls of badge material by heat welding and pressure together to form a laminated pocket;

pressing said laminated pocket into its badge retaining form;

cutting at a cutting station the laminated material into its configuration of a badge of the proper size and shape;

providing a conveyor means formed of magnetic platens and delivering said cut laminated material into alignment upon said platens for conveyance along the conveyor and into position under the vibratory pin feeder;

supplying a pin to each of said cut piece of laminated badge material, positioning said pin over said cut piece of laminated badge material and adhering said pin into its aligned position upon said badge material by means of the magnetic platens forming the conveyor means;

positioning said laminated badge magnetically held pins into alignment under a glue delivery means, applying a glue to said pin and laminated badge to affix said pin to said badge material;

conveying said pin and badge assembly to a curing station;

curing said glue with one of ultraviolet light and heat at said curing station;

conveying said glued secured pin and badge assembly to a collection station; and collecting said pin and badge assembly for packaging upon their delivery from the conveying means.

2. The invention of claim 1 wherein the method of making the laminated badge holder comprises the simultaneous forming of two vinyl badge materials, side by side, and delivering same to said magnetic platen conveyor, and the step of moving said laminated badge material in alignment with a vibratory feeder further comprises moving a plurality of said laminated badge materials in alignment with a plurality of said vibratory pin feeders, for delivering two pins simultaneously to the adjacent laminated badge material, for forming two of said pin back badge holders simultaneously.

* * * * *